United States Patent [19]

Fehrer

[11] 3,972,173

[45] Aug. 3, 1976

[54] APPARATUS FOR PRODUCING SPUN YARN FROM TEXTILE FIBERS

[76] Inventor: Ernst Fehrer, Auf der Gugl, 28, Linz, Austria

[22] Filed: Apr. 10, 1975

[21] Appl. No.: 566,992

[52] U.S. Cl. ..... 57/58.89; 57/58.95

[51] Int. Cl.[2] ..... D01H 1/12

[58] Field of Search ..... 57/50, 58.89–58.95, 57/156; 19/150, 157

[56] References Cited

UNITED STATES PATENTS

| | | | |
|---|---|---|---|
| 2,202,118 | 5/1940 | Newman et al. | 57/58.91 UX |
| 2,220,024 | 10/1940 | Pool | 57/58.91 X |
| 2,227,911 | 1/1941 | Pool | 57/58.91 X |
| 2,258,661 | 10/1941 | Pool | 57/58.91 X |
| 2,363,470 | 11/1944 | Lannan et al. | 19/150 |
| 3,330,008 | 7/1967 | Schuller | 19/150 |
| 3,343,360 | 9/1967 | Brown | 57/58.91 |
| 3,635,006 | 1/1972 | Fehrer | 57/50 |
| 3,636,693 | 1/1972 | Benson | 57/58.95 |

*Primary Examiner*—John Petrakes
*Attorney, Agent, or Firm*—Kurt Kelman

[57] ABSTRACT

A yarn is spun on a suction drum having a horizontal axis and operable to rotate in a on direction about the axis from textile fibers impinged n the drum throughout a suction zone. A suction box in the drum is operable to form the suction zone on the drum periphery and is angularly spaced by an acute angle from the zenith of the drum in an opposite direction. The suction zone has a sharply defined edge adjacent the zenith of the drum. The impinged fibers are twisted together to form a yarn tail and are subsequently spun to form a yarn under the action of components of force which are due to the rotation of the drum and the suction in the suction zone. The width of the suction zone equals the diameter of the yarn tail, measured in the predetermined direction.

2 Claims, 2 Drawing Figures

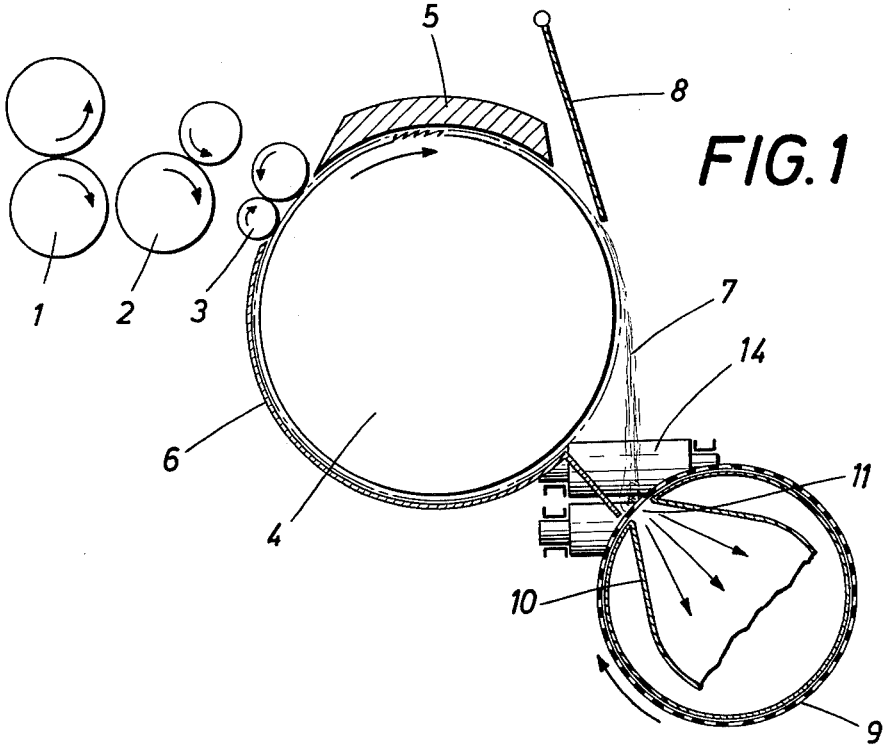
FIG. 1
FIG. 2
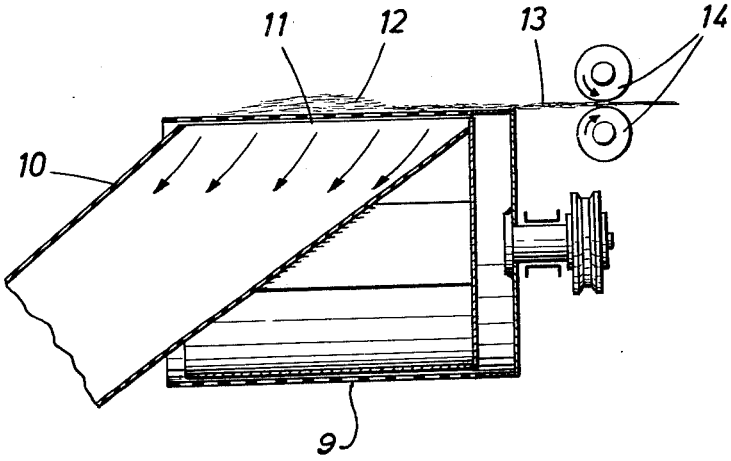

APPARATUS FOR PRODUCING SPUN YARN FROM TEXTILE FIBERS

This invention relates to apparatus for producing spun yarns from textile fibers, comprising a unit for disintegrating feed material into individual fibers, a succeeding rotary suction drum, and a pair of draw-off rollers or the like, which are disposed adjacent to one end of the suction drum, wherein the individual fibers fly freely from the disintegrating unit to the suction zone of the suction drum, which suction zone is sharply defined in the direction of rotation of the drum. The fibers are twisted together in the suction zone under the action of components of force which are due to the suction and to the rotation of the drum, and the fibers are drawn off as a yarn parallel to the axis of the drum.

Such apparatus enabling spinning at high twisting and draw-off speeds without requiring a complicated structure and parts moving at high speed has been described in the Published German Specification 2,361,313. According to that disclosure the suction zone is relatively wide in the direction of rotation of the suction drum and the area on which the scattered fibers impinge is also relatively wide in this direction. For this reason the fibers can be twisted together only at the delivery end of the suction zone and a fiber web is virtually formed in the suction zone before said delivery end and is formed into a helical coil at said delivery end. The formation of such helical coil is inconsistent with proper spinning.

For this reason it is an object of the invention so to improve the apparatus described first hereinbefore with simple means that a spun yarn having a high tensile strength can actually be produced rather than a merely helically twisted coil.

This object is accomplished according to the invention by making the width of the suction zone, measured in the direction of rotation of the suction drum, and the width of the area in which the scattered fibers impinge on the suction drum, measured in the same direction, equal to the diameter of the yarn tail which forms as a result of the twisting of the fibers before they are actually spun, and angularly spacing the suction zone by an acute angle from the zenith of the suction drum opposite to the direction of rotation of the drum.

As a result, the suction zone and the area in which the scattered fibers impinge on the suction drum are so narrow that the fiber impact zone and the yarn-forming zone coincide. No web is formed which is subsequently coiled but the impinging fibers are immediately subjected to the rotational movement and applied to the yarn tail so that a true yarn is spun. It will be understood that for this purpose there must be a sufficiently large pressure difference between the free atmosphere and the suction zone. This pressure difference amounts to at least 350 mm of water, preferably 550–600 mm of water. As a result of the angular spacing of the suction zone from the zenith of the suction drum opposite to the direction of rotation of the drum, the fibers impinge on the suction drum in an area in which the rotating shell of the drum moves upwardly so that the twisting of the fibers is assisted by gravity and the spinning effect is thus increased.

An embodiment of apparatus according to the invention is shown strictly diagrammatically and by way of example on the accompanying drawing, in which FIG. 1 is a vertical sectional view taken on a plane which is normal to the axes of the disintegrating and suction drums and FIG. 2 is a sectional view taken on a plane which extends through the axis of the suction drum.

The spinning apparatus proper is preceded by a unit which disintegrates feed material into individual fibers and which comprises a plurality of pairs of feed rollers 1, 2, 3 and a serrated carding drum 4, which rotates at high speed and is provided with a cover 5, 6. An adjustable guide wall 8 is provided in order to form a fiber stream 7 which is as narrow as possible, i.e., to minimize the area over which the ejected fibers are scattered.

This unit is succeeded by a suction drum, which has a perforated shell 9 rotating in the direction of the arrow and a suction insert 10, which forms a suction zone 11 in the area in which the fiber stream 7 impinges. In the direction of rotation of the suction drum, this suction zone 11 has the same width as the area in which the scattered fibers impinge on the suction drum. This width is, e.g., 10–12 mm. It is apparent that the suction zone 11 is angularly spaced by an acute angle of about 45° from the zenith of the suction drum 9 opposite to the direction of rotation of the drum, i.e., in the counterclockwise sense.

As the fibers impinge on the shell 9 of the suction drum, they are twisted together under the action of the components of force which are due to the suction and to the movement of the drum shell 9 and which are assisted by a gravity component. As a result, a relatively loose yarn tail 12 is initially formed and this yarn tail is subsequently consolidated to form a yarn 13. The latter is drawn off parallel to the axis of the suction drum by means of a pair of draw-off rollers 14, which are provided adjacent to and axially spaced from the end of the suction drum. The width of the suction zone is approximately as large as the diameter of the yarn tail 12.

What is claimed is:

1. Apparatus for producing spun yarn from textile fibers, comprising a suction drum having a horizontal axis and being operable to rotate in a predetermined direction about said axis, means operable to form on the periphery of said suction drum a suction zone which is angularly spaced by an acute angle from the zenith of said drum in a direction which is opposite to said predetermined direction, said suction zone having a sharply defined edge adjacent to said zenith, a disintegrating unit operable to disintegrate feed material into individual fibers and to release said fibers to fly off freely and to be scattered and impinge on said suction drum throughout said suction zone, whereby said fibers which have impinged on said suction drum in said suction zone are twisted together to form a yarn tail and are subsequently spun to form a yarn under the action of components of force which are due to the rotation of said suction drum and the suction in said suction zone, the width of said suction zone, measured in said predetermined direction, being equal to the diameter of said yarn tail, and draw-off means disposed adjacent to and axially spaced from one end of said suction drum and operable to draw off said yarn from said suction zone parallel to the axis of said drum.

2. Apparatus as set forth in claim 1, in which said draw-off means comprise a pair of draw-off rollers.

* * * * *